US007896203B2

(12) United States Patent
Myron

(10) Patent No.: US 7,896,203 B2
(45) Date of Patent: Mar. 1, 2011

(54) DISPENSING APPARATUS

(76) Inventor: Ezra Myron, Port Saint Lucie, FL (US)

( * ) Notice: Subject to any disclaimer, the term of this patent is extended or adjusted under 35 U.S.C. 154(b) by 448 days.

(21) Appl. No.: 12/047,777

(22) Filed: Mar. 13, 2008

(65) Prior Publication Data

US 2009/0230155 A1 Sep. 17, 2009

(51) Int. Cl.
*B65D 83/00* (2006.01)

(52) U.S. Cl. ..... 222/401; 222/209; 222/380; 222/386.5; 222/402; 222/400.8; 222/481.5

(58) Field of Classification Search ..... 222/401–402, 222/386.5, 389, 394, 400.8, 481.5, 380, 209; 137/212

See application file for complete search history.

(56) References Cited

U.S. PATENT DOCUMENTS

| | | | | |
|---|---|---|---|---|
| 19,677 | A * | 3/1858 | Chaille et al. | 249/123 |
| 2,060,512 | A * | 11/1936 | Magill | 222/400.8 |
| 2,061,240 | A * | 11/1936 | Leins | 222/399 |
| 2,241,097 | A * | 5/1941 | Mezzapesa | 222/83 |
| 2,612,297 | A * | 9/1952 | Bain | 222/401 |
| 2,723,056 | A * | 11/1955 | Smith | 222/396 |
| 3,998,361 | A * | 12/1976 | Arena | 222/182 |
| 4,392,578 | A * | 7/1983 | Fipp et al. | 215/231 |
| 4,763,818 | A * | 8/1988 | Stefano et al. | 222/209 |
| 5,248,064 | A * | 9/1993 | Claycomb, Jr. | 222/95 |
| 5,749,502 | A * | 5/1998 | Hinds | 222/401 |
| 5,752,625 | A * | 5/1998 | Stucki | 222/82 |
| 7,232,046 | B1 * | 6/2007 | Stassi | 222/400.8 |

* cited by examiner

*Primary Examiner*—Frederick C. Nicolas
(74) *Attorney, Agent, or Firm*—Michael Ries

(57) ABSTRACT

A dispensing apparatus capable of being detachably coupled to a container for dispensing liquid from the container is disclosed. The dispensing apparatus includes a central unit, a pump, a release valve assembly, a pipe, and a nozzle. The central unit is configured to detachably couple with an opening of the container containing the liquid. The pump is configured at a first end portion of the central unit. The pump is operable to generate pressure within the container. The release valve assembly is configured in the central unit. The release valve assembly is capable of controlling a flow of the liquid from the container and dispensing the liquid. The pipe is attached to the release valve assembly. The pipe is capable of carrying the liquid to be dispensed. The nozzle is configured at a second end portion of the central unit and is capable of dispensing the liquid from the pipe.

6 Claims, 2 Drawing Sheets

DISPENSING APPARATUS

FIELD OF THE INVENTION

The present invention relates generally to liquid dispensing mechanisms, and, more particularly, to a dispensing apparatus for dispensing liquid from a container.

BACKGROUND OF THE INVENTION

Consumable liquids are usually packed in containers such as bottles, cans, and the like. Consumers usually have to open the container numerous times to use a liquid present in the container. Accordingly, opening of the container for using the liquid may cause spilling of the liquid which in turn may lead to loss of content as well as freshness of the liquid therewithin.

Typically, in case of a packaged beverage such as a beverage container, a consumer usually uncaps the beverage container multiple times to consume the beverage. As a result, the beverage may lose its taste and freshness. More specifically, the beverage such as a soda may lose its carbon dioxide content when a soda bottle is opened several times by the consumer. Moreover, when the packaged beverage is held and uncapped by consumers, such as children, the beverage may spill out more often.

Accordingly, it is desirable to have a dispensing apparatus that is capable of being easily attached to a beverage container containing a liquid. Further, there is a need for a dispensing apparatus that reduces spillage of the liquid and retains the freshness and taste of the liquid. Additionally, there is a need for a dispensing apparatus which is portable.

SUMMARY OF THE INVENTION

In view of the foregoing disadvantages inherent in the prior art, the general purpose of the present invention is to provide a dispensing apparatus configured to include all the advantages of the prior art, and to overcome the drawbacks inherent therein.

Accordingly, an object of the present invention is to provide a dispensing apparatus that is capable of being easily attached to an opening of a container containing a liquid.

Another object of the invention is to provide a dispensing apparatus that retains the freshness and taste of the liquid.

In yet another object of the invention is to provide a dispensing apparatus that reduces spillage of the liquid.

Still yet another object of the invention is to provide a dispensing apparatus that is portable.

In light of the above objects, in one aspect of the present invention, a dispensing apparatus for dispensing liquid from a container is disclosed. The dispensing apparatus includes a central unit, a pump, a release valve assembly, a pipe, and a nozzle. The central unit is configured to detachably couple with an opening of the container. The pump is configured at a first end portion of the central unit. The pump is operable to generate pressure within the container. The release valve assembly is configured in the central unit. The release valve assembly is capable of controlling a flow of the liquid from the container and dispensing the liquid. The pipe is attached to the release valve assembly. The pipe is capable of carrying the liquid to be dispensed. The nozzle is configured at a second end portion of the central unit. During operation, when the pump is operated, the pump generates pressure within the container thereby enabling the liquid within the container to rise through the pipe. When the release valve assembly is operated, the release valve assembly dispenses the liquid within the pipe through the nozzle.

In another aspect of the present invention, a dispensing apparatus is provided that is portable. More specifically, the dispensing apparatus is composed of a plastic material, thereby enabling a convenient portability thereof.

These together with other aspects of the present invention, along with the various features of novelty that characterize the present invention, are pointed out with particularity in the claims annexed hereto and form a part of this present invention. For a better understanding of the present invention, its operating advantages, and the specific objects attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE INVENTION

The exemplary embodiments described herein detail for illustrative purposes are subject to many variations in structure and design. It should be emphasized, however, that the present invention is not limited to a particular dispensing apparatus, as shown and described. It is understood that various omissions and substitutions of equivalents are contemplated as circumstances may suggest or render expedient, but these are intended to cover the application or implementation without departing from the spirit or scope of the claims of the present invention.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present invention provides a dispensing apparatus for dispensing liquids from containers. The dispensing apparatus is capable of being easily attached to an opening of a container containing a liquid. Accordingly, the dispensing apparatus is capable of retaining freshness and taste of the liquid therewithin.

Figure 1:
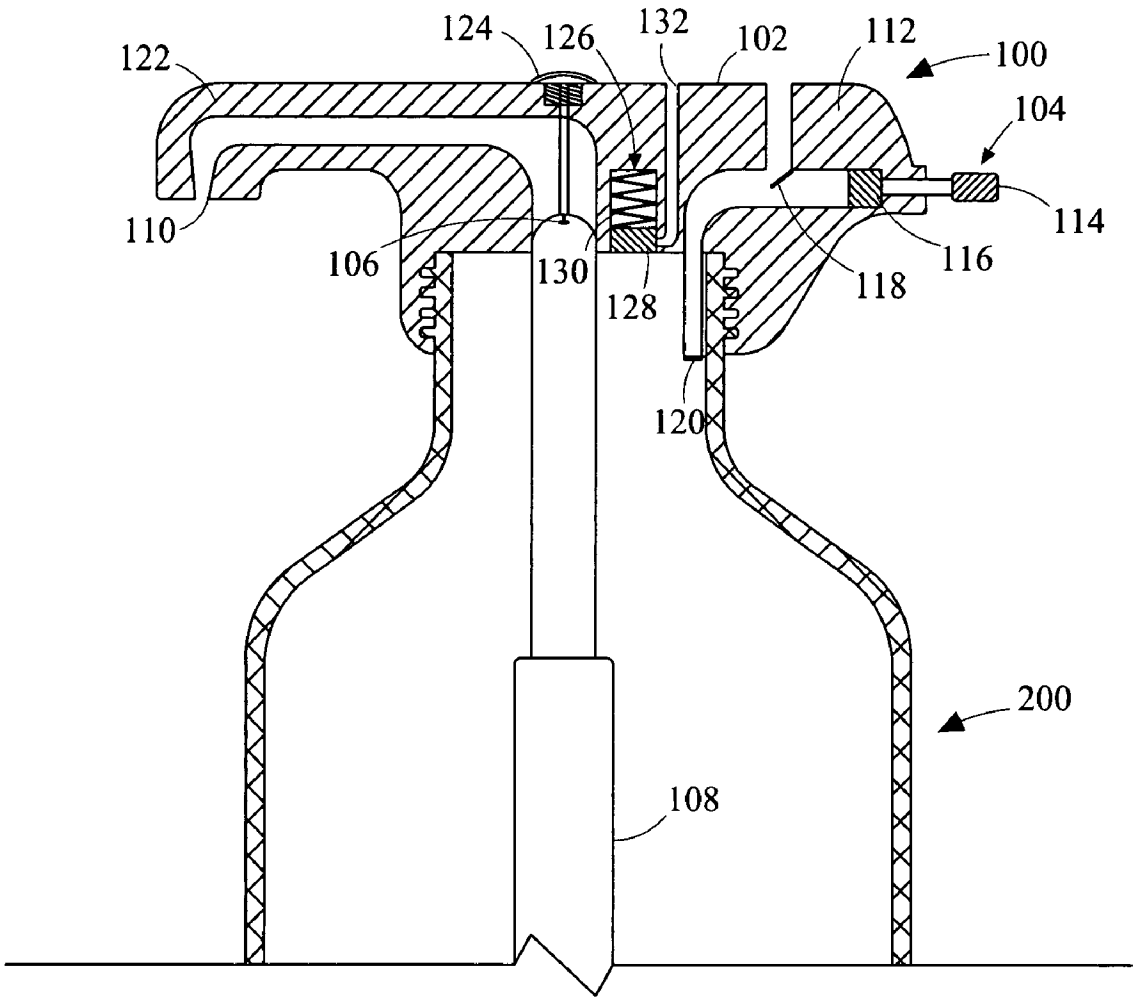
FIG. 1 illustrates a sectional view of a dispensing apparatus detachably coupled to a container, in accordance with an exemplary embodiment of the present invention.

Referring to FIG. 1, illustrated is an assembled configuration of a dispensing apparatus 100 coupled to a container, such as a bottle 200. More specifically, FIG. 1 illustrates a sectional view of the dispensing apparatus 100 detachably coupled to the bottle 200 to form the assembled configuration. The dispensing apparatus 100 may be coupled with the bottle 200 containing the liquid after removing a cap (not shown) of the bottle 200. The bottle 200 may be, for example, a beverage bottle, a soda bottle, a juice bottle, and the like. The liquid contained in the bottle 200 may be, for example, a soda, a juice, and the like.

The dispensing apparatus 100 includes a central unit 102, a pump 104, a release valve assembly 106, a pipe 108, and a nozzle 110. The central unit 102 is detachably coupled to an opening of the bottle 200. In one embodiment of the present invention, the central unit 102 may have internal threads to detachably couple to external threads disposed on a neck of the bottle 200 for coupling the dispensing apparatus 100 to the bottle 200.

The pump 104 is configured at a first end portion 112 of the central unit 102, as shown in FIG. 1. The pump 104 is operable to generate pressure within the bottle 200. The pump 104 may be a pump piston or any other pumps known in the art for generating pressure. In one embodiment of the present invention, the pump 104 may be configured to move back and forth when operated manually by a user. More specifically, the user may manually move the pump 104 back and forth using fingers. Such back and forth motion enables the pump 104 to generate pressure within the bottle 200.

In another embodiment of the present invention, the pump 104 includes a holder 114 connected to a piston head 116. The central unit 102 may include a valve arrangement for operation of the pump 104. More specifically, during operation, when the pump 104 is pulled by the user using the holder 114 to a backward position, the pump 104 sucks air from atmosphere through a first valve 118 configured in the central unit 102. The air is sucked through an inlet passage 119 configured in the central unit 102. Further, while sucking the air from the atmosphere, a second valve 120 configured in the central unit 102 may be in a closed position as illustrated in FIG. 1. Thereafter, the pump 104 may be pushed to a forward position forcing the sucked air to be transferred to an interior portion of the bottle 200 containing the liquid. As a result, pressure is generated within the bottle 200. More specifically, while pushing the pump 104, the first valve 118 closes and the second valve 120 opens allowing the sucked air to be pushed into the bottle 200. It should be obvious to a person skilled in the art that such a configuration of the pump 104 along with the first valve 118 and the second valve 120 is an exemplary representation and should not be considered a limitation of the dispensing apparatus 100. A variety of other configurations of the pump 104 and valve arrangements, such as the first valve 118 and the second valve 120 may be used in the present invention.

The release valve assembly 106 is configured in the central unit 102. The release valve assembly 106 is capable of controlling a flow of the liquid from the bottle 200 and dispensing the liquid. The pipe 108 capable of carrying the liquid to be dispensed is attached to a bottom portion of the release valve assembly 106. In one embodiment of the present invention, the pipe 108 may be a two piece friction fit siphon pipe. In such a case, the pipe 108 may include two pieces of pipes that may assist in carrying liquids contained in the bottles having greater heights. The nozzle 110 is configured at a second end portion 122 of the central unit 102.

Figure 2:
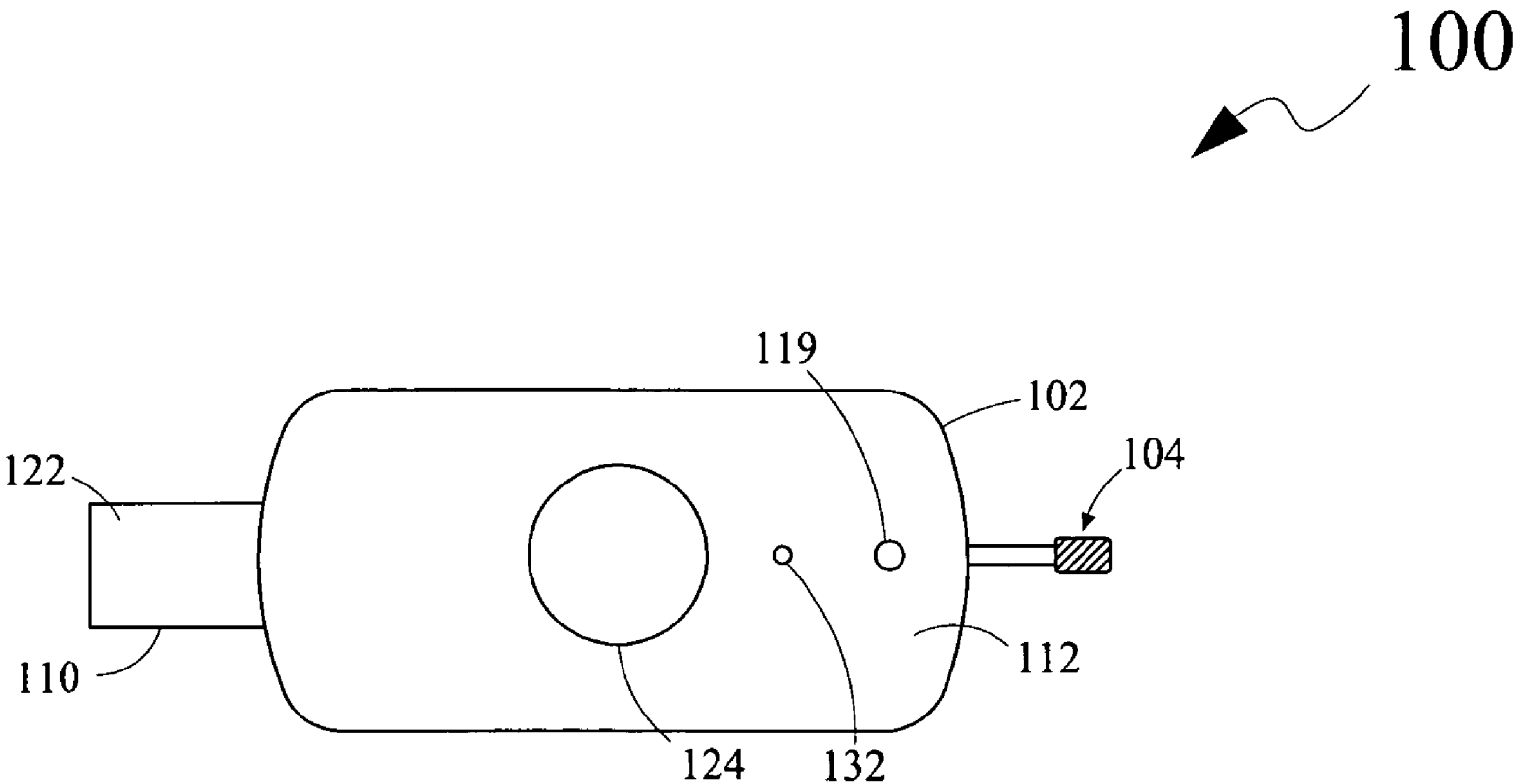
FIG. 2 illustrates a top view of the dispensing apparatus, in accordance with the exemplary embodiment of the present invention.

The dispensing apparatus 100 may further include a release button 124. The release button 124 is configured in the central unit 102. More specifically, the release valve assembly 106 may be coupled with the release button 124 configured at a top portion of the central unit 102 as illustrated in FIG. 1. The release button 124 is capable of being activated to operate the release valve assembly 106 for discharging the liquid. In one embodiment, the release button 124 may be manually operated by a user using a finger. It is obvious to a person skilled in the art to use different configurations of the release button 124 for purposes of operating the release valve assembly 106 and the description and illustration should not be construed as a limitation. FIG. 2 illustrates a top view of the dispensing apparatus 100 as depicted in FIG. 1.

During operation, once the pump 104 is operated, pressure is generated within the bottle 200 having liquid such as a beverage, the liquid may rise through the pipe 108. The liquid that flows through the pipe 108 is prevented from flowing through the nozzle 110 by the release valve assembly 106. Thereafter, the user may manually operate the release button 124 to open the release valve assembly 106 to enable the liquid present in the pipe 108 to flow through the nozzle 110.

In another embodiment of the present invention, the dispensing apparatus 100 may further include a pressure relief valve 126 capable of releasing additional pressure with regard to excess accumulated air within the bottle 200, thereby preventing the bottle 200 from bursting. The excess accumulated air may be created while generating pressure within the bottle 200 using the pump 104 as described above. The pressure relief valve 126 may be configured in the central unit 102. In an exemplary embodiment of the present invention, the pressure relief valve 126 includes a piston head 128 and a spring mechanism 130 operatively coupled to the piston head 128. Moreover, the spring mechanism 130 may be coupled to an inner surface of the central unit 102 to enable the piston head 128 to move in a first direction for example, upwardly and a second direction for example, downwardly. The central unit 102 may further include a passage 132 connected to the piston head 128. It should be obvious to a person skilled in the art that such a configuration of the pressure relief valve 126 along with the passage 132 is an exemplary representation and should not be considered a limitation of the dispensing apparatus 100. A variety of other configurations of pressure relief valve arrangements, such as pressure relief valve 126 and passage 132 may be used in the present invention.

During operation, when the pressure within bottle 200 rises beyond a specific pressure limit, the excess accumulated air forces the piston head 128 to move in the first direction by compressing the spring mechanism 130. Consequently, the passage 132 opens allowing the excess accumulated air to flow from the bottle 200 to atmosphere thereby releasing the additional pressure. Once, the pressure within the bottle 200 is within the specific pressure limit, the spring mechanism 130 decompresses allowing the piston head 128 to move in the second direction. As a result, the passage 132 closes.

The dispensing apparatus 100, in an embodiment of the present invention, may be composed of a plastic material such as a food grade plastic. However, it will be apparent to a person ordinarily skilled in the art that the dispensing apparatus 100 may be composed of any other known material. In another embodiment of the present invention, the dispensing apparatus 100 may be available in different colors to enhance the aesthetic value of the dispensing apparatus 100. In an alternate embodiment of the present invention, the dispensing apparatus 100 may be available in various sizes, thereby enabling the dispensing apparatus 100 to be coupled with containers of various sizes.

The present invention provides a dispensing apparatus for dispensing a liquid from a container, such as a beverage bottle. The dispensing apparatus retains freshness and taste of a liquid as the dispensing apparatus need not be removed numerous times by a consumer for consuming the liquid therewithin. Further, the dispensing apparatus prevents spillage of the liquid and eliminates a need for lifting the bottle to take the liquid. Accordingly, the dispensing apparatus enables consumer such as children to use the bottle coupled with the dispensing apparatus more efficiently and without any spillage thereby retaining the taste and freshness of the liquid present in the bottle. Moreover, the dispensing apparatus may have a compact structure, thereby enabling portability thereof. Additionally, the dispensing apparatus is designed in a manner such that the dispensing apparatus may be easily coupled to the bottle. Furthermore, the dispensing apparatus may be provided in a variety of colors, thereby enhancing the aesthetic value of the dispensing apparatus.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, and to thereby enable others skilled in the art to best utilize the present invention and various embodiments with various modifications as are suited to the particular use contemplated. It is understood that various omissions and substitutions of equivalents are contemplated as circumstances may suggest or render expedient, but these are intended to cover the application or implementation without departing from the spirit or scope of the claims of the present invention.

What is claimed is:

1. A dispensing apparatus for dispensing liquid from a container, the dispensing apparatus comprising:

a central unit configured to detachably couple with an opening of the container;

a pump configured at a first end portion of the central unit, the pump operable to force air into the container such that the air contacts the liquid and generates pressure therein;

a release valve assembly configured in the central unit, the release valve assembly capable of controlling a flow of the liquid from the container and dispensing the liquid;

a pipe attached to the release valve assembly for carrying the liquid to be dispensed, the pipe extending into the liquid; and a nozzle configured at a second end portion of the central unit, wherein upon operating the pump, the pump generates pressure within the container thereby enabling the liquid within the container to rise through the pipe, and wherein upon operating the release valve assembly, the release valve assembly dispenses the liquid within the pipe through the nozzle.

2. The dispensing apparatus of claim 1, wherein the pump is a piston pump manually operated by a user.

3. The dispensing apparatus of claim 1, further comprising a release button configured in the central unit, wherein the release button is capable of being activated to operate the release valve assembly for dispensing the liquid.

4. The dispensing apparatus of claim 1, wherein the dispensing apparatus is composed of a plastic material.

5. The dispensing apparatus of claim 1, further comprising a pressure relief valve configured in the central unit, wherein the pressure relief valve is capable of maintaining the pressure in the container below a specific pressure limit.

6. A dispensing apparatus for dispensing liquid from a container, the dispensing apparatus comprising:

a central unit detachably coupled with an opening of the container;

a pump coupled to a first end portion of the central unit, the pump operable to force air into the container such that the air contacts the liquid and generates pressure therein;

a release valve assembly interposed within the central unit, the release valve assembly for controlling a flow of the liquid from the container and dispensing the liquid;

a pipe attached to the release valve assembly for carrying the liquid to be dispensed, the pipe extending into the liquid such that the liquid contacts both an inside surface and an outside surface of the pipe;

a pressure relief valve for maintaining the pressure in the container below a specific pressure limit; and a nozzle configured at a second end portion of the central unit, wherein upon operating the pump, the pump generates pressure within the container thereby enabling the liquid within the container to rise through the pipe, and wherein upon operating the release valve assembly, the release valve assembly dispenses the liquid within the pipe through the nozzle.

* * * * *